US007513643B2

(12) United States Patent
Williams

(10) Patent No.: US 7,513,643 B2
(45) Date of Patent: Apr. 7, 2009

(54) LIGHT SUPPORT APPARATUS AND ASSOCIATED METHOD OF USE

(76) Inventor: Henry Williams, 4408 Barrington Trail, Killeen, TX (US) 76549-2551

( * ) Notice: Subject to any disclaimer, the term of this patent is extended or adjusted under 35 U.S.C. 154(b) by 242 days.

(21) Appl. No.: 11/104,806

(22) Filed: Apr. 13, 2005

(65) Prior Publication Data

US 2006/0232967 A1 Oct. 19, 2006

(51) Int. Cl.
*F21V 21/00* (2006.01)

(52) U.S. Cl. ..... 362/249; 362/391; 362/396; 248/301

(58) Field of Classification Search ..... 362/249, 362/252, 391, 396; 248/237, 301, 65, 314; D26/25, 138
See application file for complete search history.

(56) References Cited

U.S. PATENT DOCUMENTS

| | | | | |
|---|---|---|---|---|
| 5,110,078 | A * | 5/1992 | Gary | 362/249 |
| 5,893,628 | A * | 4/1999 | Byers | 362/252 |
| 2003/0066938 | A1 * | 4/2003 | Zimmerman | 248/301 |
| 2003/0235053 | A1 * | 12/2003 | Jones | 362/396 |

* cited by examiner

*Primary Examiner*—Stephen F Husar
(74) *Attorney, Agent, or Firm*—Locke Lord Bissell & Liddell, LLP

(57) ABSTRACT

A light strand support apparatus having two slots for receiving and securing a light strand. Each slot is held fixed with respect to other. The apparatus holds each light strand at a fixed distance from a surface or object as the slots are supported by a central component that extends from a support. The support is configured to rest flush against a given surface or object.

9 Claims, 2 Drawing Sheets

LIGHT SUPPORT APPARATUS AND ASSOCIATED METHOD OF USE

BACKGROUND OF THE INVENTION

1. Field of the Invention

The present invention generally relates to an apparatus for supporting two strands of lights at one time. More specifically, the present invention relates to an apparatus for support two light strands at one time where each light strand is secured within said apparatus and held at a fixed distance from a support surface.

2. Background Information

It is extremely common for people to string strands of lights for festive occasions. In this country, strands of lights are typically strung during the holiday periods on houses and buildings to provide a festive atmosphere. Typically, the strands of lights have one or more wires that extend in a long strand with lights periodically spaced along the strand. One typical hanger for strands of lights is a screw hook which has hook portion that is attached to a screw member. The hook portion is then used to urge the screw member into a surface, such as a wooden eave surrounding the outside perimeter of the house. While the screw hooks do permit the mounting of strands of lights to surfaces, such as wooden eaves, they suffer from some difficulties. The hook member is often sufficiently wide such that it does not prevent the strands of lights from twisting when positioned within the hook opening. Often, the person stringing the strands of lights wants lights to be oriented in a particular direction to obtain the best possible display of lights. If the cord is twisted in the light hangers, it is difficult, if not impossible, to make sure that the lights are hanging in a desired way. This is a difficulty that occurs with many light strand hangers, not just screw hook hangers.

A further difficulty that occurs with screw hook hangers is that the installer screws the screw into the surface while grasping the hook portion of the screw hook. If the surface is hard, it can be difficult to get the screw hook into the surface. Moreover, this type of hanger does not allow the installer to make use of tools like screwdrivers and the like. Thus, the installation process is more difficult using these types of hangers.

Other methods that are used to hang light strands have difficulties as well. One popular method is to staple the light strands directly onto the structure. Stapling can result in a sharp staple damaging the insulating material of the wires. Another method is to use light hangers that attach to shingles or gutters. The problem with such hangers is that their use requires a presence of shingles or gutters. This restriction limits the usefulness of such hangers. Importantly, none of the mechanisms herein described provide any means whereby two light strands may be secured at the same time with a single device. So, while the above mechanisms fail to adequately support a single light strand, each wholly fails at the possibility of supporting two light strands.

In view of the above, it will be appreciated that there is a need for an improved light strand hanger that allows two light strands to be secured at one time and would also provided for efficient installation. Moreover, what is needed is a light strand support that is adapted to allow the user to install the light strands so that the lights hang in a desired orientation. To this end, there is a need for a light strand hanger which can be installed using tools, such as screwdrivers, and is also configured to prevent the light strand from twisting in the hanger.

SUMMARY OF THE INVENTION

The general purpose of the present invention, which will be described subsequently in greater detail, is to provide a new Light Support Apparatus and Associated Method of Use which has many of the advantages of such known in the art and many novel features that result in a new Light Support Apparatus and Associated Method of Use which is not anticipated, rendered obvious, suggested, or even implied by any of the known Light apparatus, either alone or in any combination thereof.

In satisfaction of the above, the present invention provides Light Support Apparatus and Associated Method of Use. The present invention, by way of a novel arrangement of components parts, yields results that simply are not possible with any other known products. Applicant's invention provides a mechanism for supporting two light strands at one time whereby two light strand receiving members are held fixed with respect to one another and supported by an elongate member and support member combination. The elongate member extends between each light receiving member and the support member and provides adequate spacing there between. The support member is configured to rest flush, and engage with, a given surface or object.

BRIEF DESCRIPTION OF THE DRAWINGS

Applicant's invention may be further understood from a description of the accompanying drawings, wherein unless otherwise specified, like referenced numerals are intended to depict like components in the various views.

DETAILED DESCRIPTION OF THE PREFERRED EMBODIMENT

Figure 1:
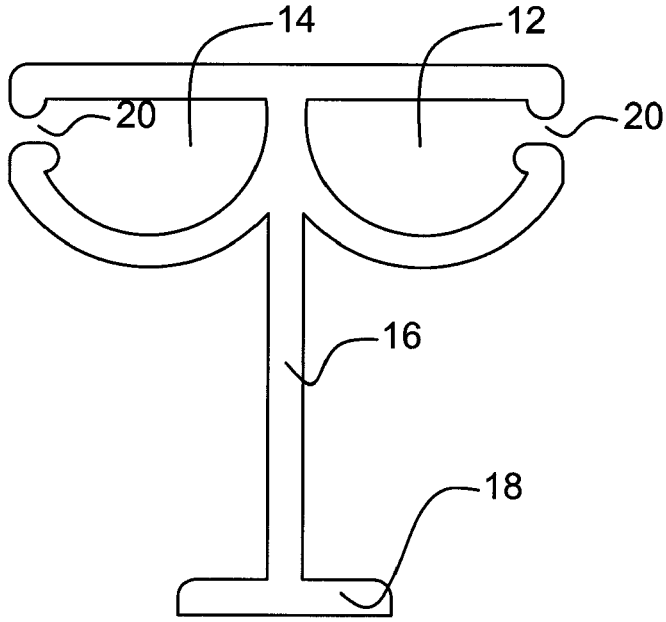
FIG. 1 is a cross section view of the preferred embodiment of the present invention.
Figure 2:
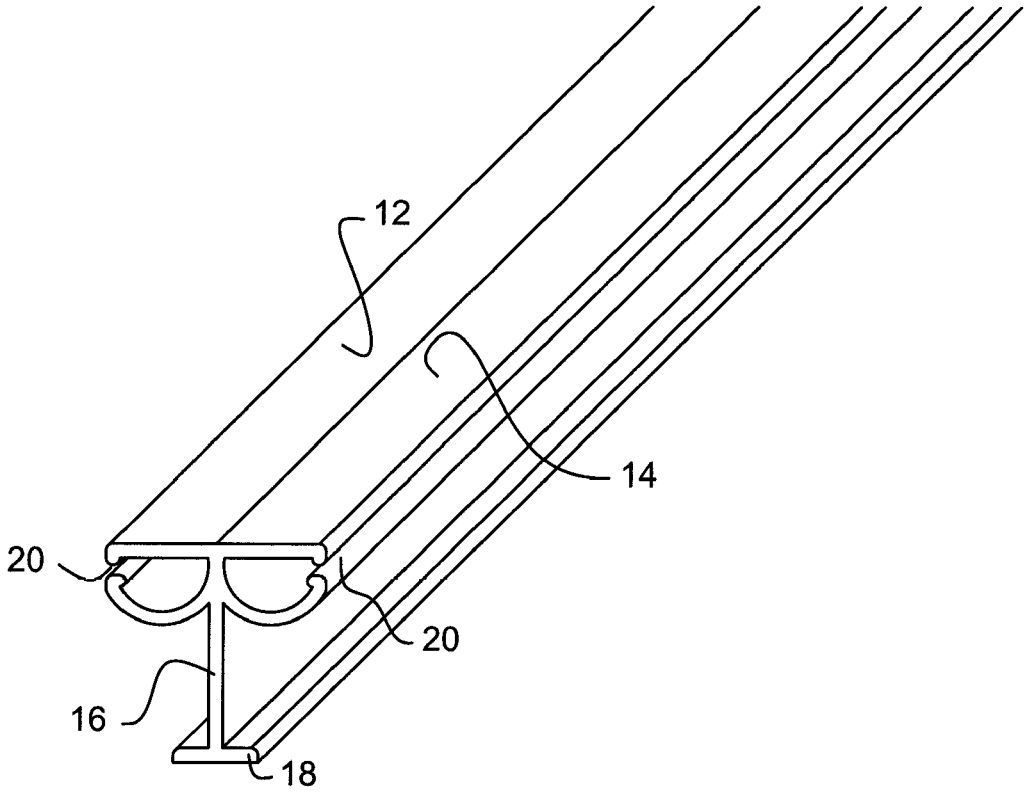
FIG. 2 is a perspective view of a preferred embodiment of the present invention.

Referring to FIG. 1 1, Applicant's invention is generally designated by reference number 10. Device 10 is characterized by first light receiving member 12, second light receiving member 14, elongate member 16, and support member 18.

Figure 3:
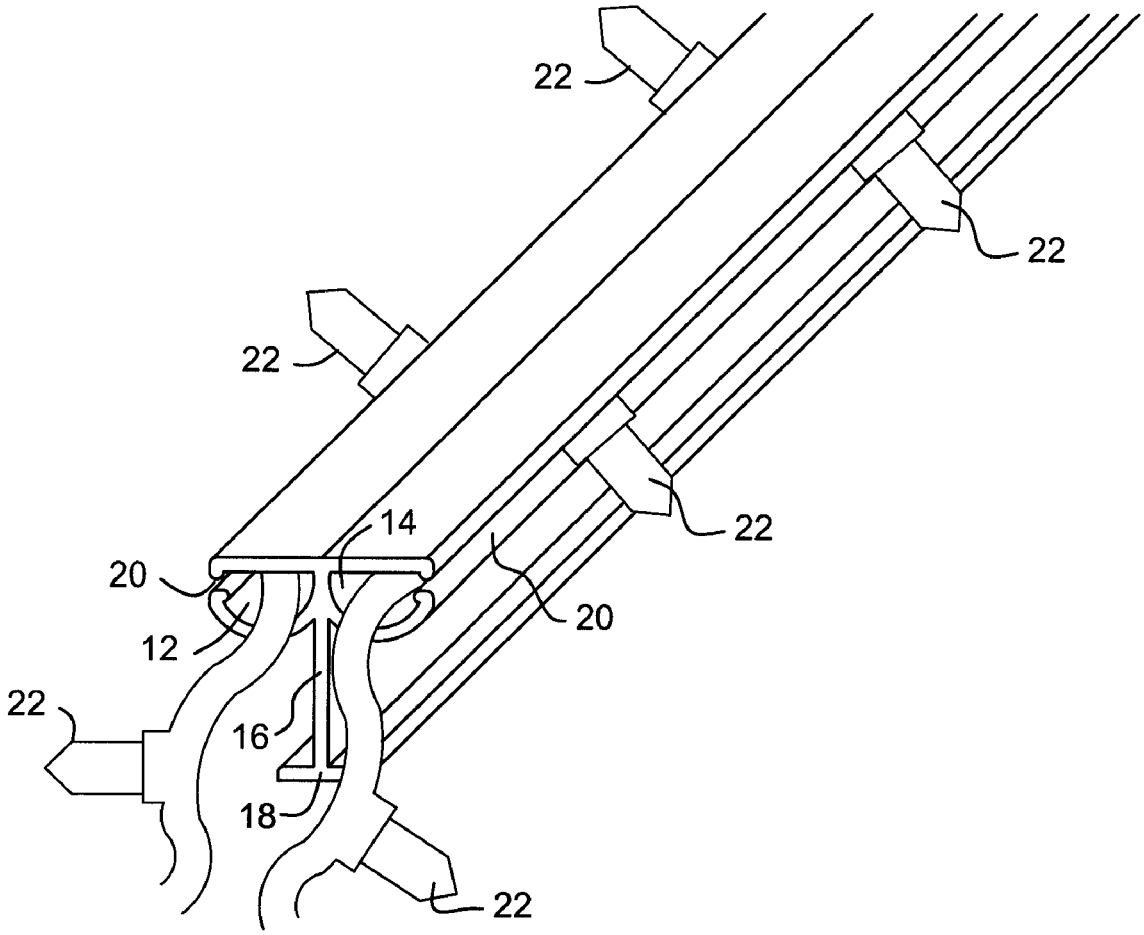
FIGS. 3 is a perspective view of an embodiment of the present invention including decorative lights.

Referring the FIG. 3. device 10 is shown supporting two strands 22 of decorative lights. Lights 24, extend from light receiving members 12 and 14 through aperture 20.

Again referring to FIG. 1, each light receiving member 12 & 14 are generally cylindrical in shape and have an aperture 20. The shape and dimension of first receiving member 12 and second receiving member 14 is conducive to securely hold a strand of lights placed therein. Aperture 20 is configured for receiving a strand of lights where each strand is securely held in place within first receiving member 12 and second receiving member 14. That is, during operation a strand of lights may be received at aperture 20 and held securely in place by first receiving member 12 and second receiving member 14. Device 10, therefore, is capable of securing two light strands as opposed to just one. This feature is not available with any other products known in the art.

Elongate member 16 extends in orthogonal fashion from the longitudinal axis of the combination of first receiving member 12 and second receiving member 14. Elongate member 16 serves to hold each receiving member 12 and 14 fixed with respect to support member 18 and is of sufficient size and dimension to allow sufficient space between each strand of light and support member 18. This is particularly important as each light strand is preferably held at a sufficient distance from any surface or object engaged with support member 18.

Finally support member 18 extends in substantially orthogonal fashion from elongate member 16 and is configured to engage or mate with any number of surfaces or object s known in the art. Specifically, support member 18 may receive any number of adhesive to bind to a surface or object. Moreover, member 18 may receive an attachment means (not pictured) such as nails, pins, or screws so as to be joined with a surface or object.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A device for attaching a string of decorative lights to a building, comprising:

an attachment member configured to engage a building;

a receiving member configured to receive and hold at least a portion of a string of decorative lights;

an opening defined in the receiving member and configured to allow at least a portion of a decorative light to extend from the receiving member, wherein the receiving member is configured so that, when engaging the string of decorative lights, the receiving member extends longitudinally along the string of decorative lights for a distance equal to at least twice the cross-sectional distance between said attachment member and said opening;

a connecting member connecting the attachment member to the receiving member.

2. The device of claim 1 wherein the opening is configured to orient each light extending therefrom in a similar direction.

3. The device of claim 1 further comprising:

a second receiving member, also connected to the connecting member configured to receive and hold at least a portion of a second string of decorative lights;

a second opening defined in the second receiving member and configured to allow at least a portion of a decorative light of said second string of decorative lights to extend from the second receiving member, wherein the second receiving member is configured so that, when engaging the string of decorative lights, the second receiving member extends longitudinally along the string of decorative lights for distance equal to at least twice the cross-sectional distance between said attachment member and said second opening.

4. The device of claim 3 further comprising an adhesive on the attachment member.

5. A device for attaching a string of decorative lights to a building, comprising:

an attachment member configured to engage a building;

a receiving member configured to receive and hold at least a section of a string of decorative lights, wherein the receiving member is configured so that, when engaging a string of decorative lights, it extends longitudinally along the string of decorative lights for a distance a equal to or greater than a distance between 2 lights of the string of decorative lights;

a connecting member connecting the attachment member to the receiving member.

6. The device of claim 5 wherein the receiving member comprises an opening extending along the receiving member, wherein the opening is configured to allow at least a portion of the a decorative light to extend outside of the receiving member.

7. The device of claim 6 wherein the opening is configured to orient each light extending therefrom in a similar direction.

8. The device of claim 5 further comprising a second receiving member, also connected to the connecting member, configured to receive and hold at least a section of a second string of decorative lights, wherein the second receiving member is configured so that, when engaging the string of decorative lights, the second receiving member extends longitudinally along the string of decorative lights for a distance equal or greater than a distance between 2 lights of the second string of decorative lights.

9. The device of claim 5 further comprising an adhesive on the attachment member.

* * * * *